United States Patent [19]

Doherty

[11] 4,067,538

[45] Jan. 10, 1978

[54] MOLD FOR MAKING FRUSTO-CONICAL PLUGS

[76] Inventor: Walter G. Doherty, Rte. 52, Stormville, N.Y. 12582

[21] Appl. No.: 725,976

[22] Filed: Sept. 23, 1976

[51] Int. Cl.[2] ..... B28B 7/26

[52] U.S. Cl. ..... 249/119

[58] Field of Search ..... 249/119–121, 249/160, 163, 165, 174

[56] References Cited

U.S. PATENT DOCUMENTS

| | | | |
|---|---|---|---|
| 683,367 | 9/1901 | Wood | 249/174 |
| 1,362,178 | 12/1920 | Pfeil et al. | 249/119 |
| 1,506,539 | 8/1924 | McCoy et al. | 249/119 |
| 1,948,147 | 2/1934 | Warren | 249/119 |
| 2,411,193 | 11/1946 | Cummins | 249/119 |
| 3,721,419 | 3/1973 | Bolinger | 249/120 |

FOREIGN PATENT DOCUMENTS

| | | | |
|---|---|---|---|
| 20,336 of | 1905 | United Kingdom | 249/119 |

*Primary Examiner*—Francis S. Husar
*Assistant Examiner*—John McQuane

[57] ABSTRACT

This invention provides an improved mold for manufacturing plugs used in the repair of small holes in pavement.

2 Claims, 8 Drawing Figures

Fig. 1
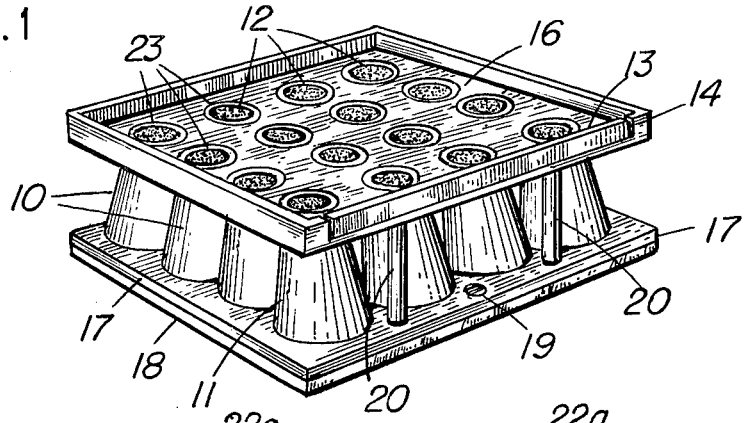
Fig. 2
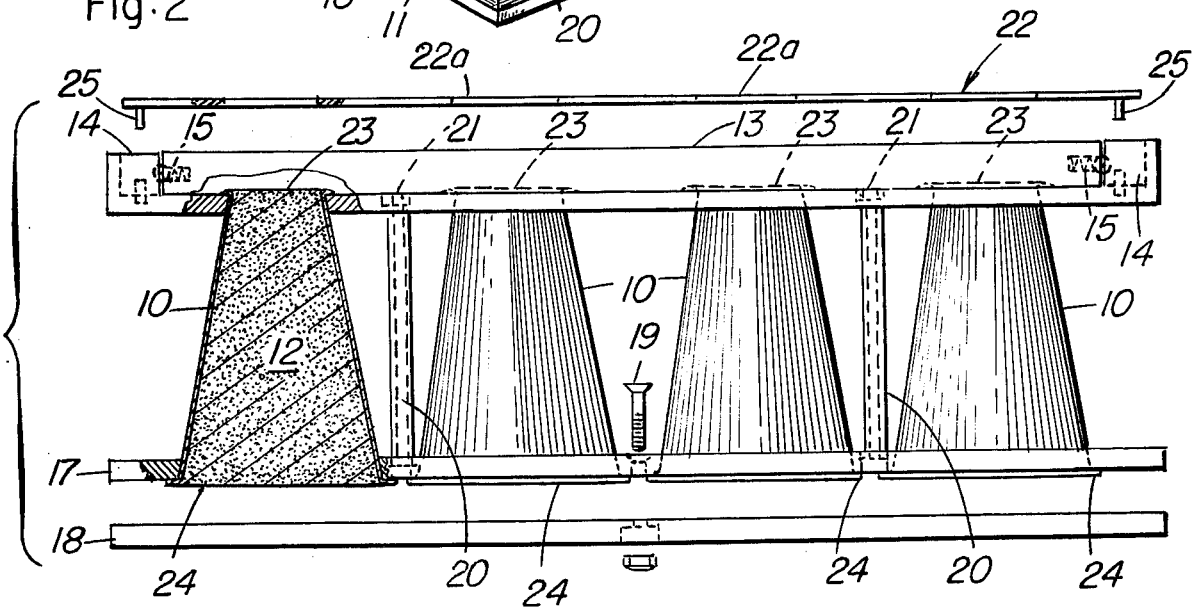
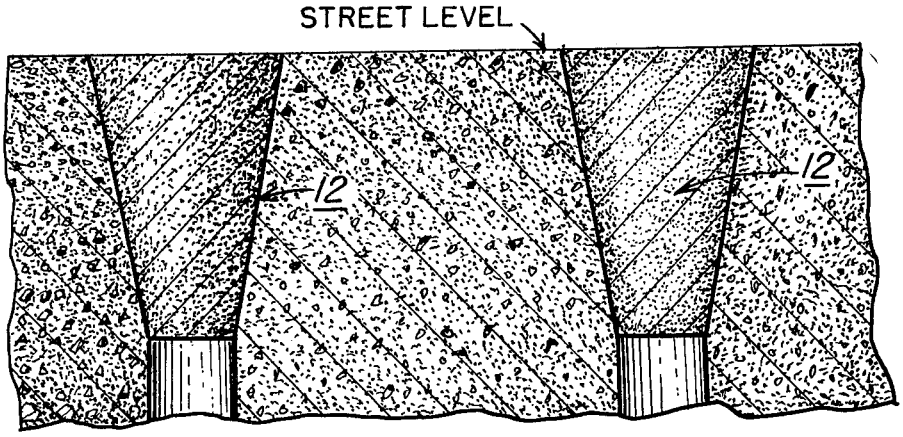
Fig. 3

Fig. 6
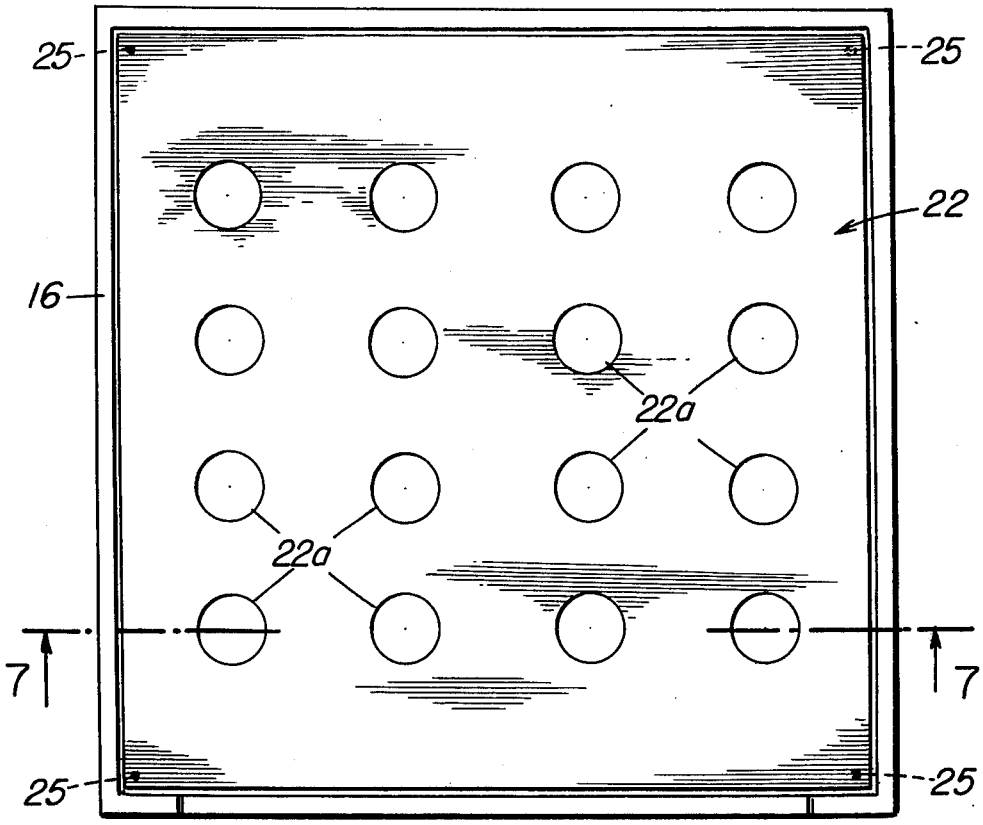
Fig. 6a
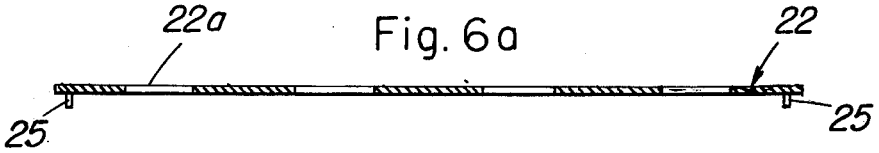
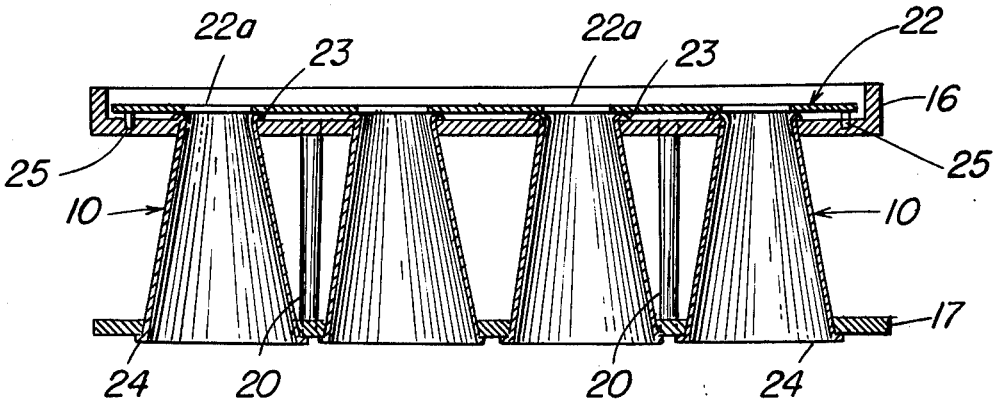
Fig. 7

MOLD FOR MAKING FRUSTO-CONICAL PLUGS

PLUGS FOR PAVEMENT REPAIR

This invention relates to an improved mold for manufacturing plugs of bituminous material useful for filling holes in pavement.

BACKGROUND AND PRIOR ART

It often becomes necessary to drill small holes called bar-holes in roads for the purpose of locating and servicing gas mains and the like. Unfortunately in regions of heavy traffic such as those encountered in cities these bar-holes are often enlarged into large pot-holes which do damage to passing vehicles. In U.S. Pat. No. 3,699,854 a convenient, novel method of repairing pavement having these bar-holes was disclosed. In this method plugs of bituminous material containing at least 50 parts by weight of asphalt as well as other ingredients are formed in a flexible matrix which serves as both mold and package for at least one plug. These plugs are formed in a variety of sizes having a first end with a smaller cross-section and a second end with a larger cross-section. The first, smaller end is inserted into the bar-hole and pressure is applied to the second, larger end until the plug is forced downward and forms a surface that is smooth and integral with the adjacent pavement. According to the known method, however, the larger second end of the plug is formed at the open top of a mold cavity or truncated cone with a somewhat irregular surface due to solidification of the bituminous material. This irregular surface often causes an irregular application of pressure to the plug during the pavement repair and thus an irregularly repaired surface results.

OBJECTS OF THE INVENTION

It is an object of this invention to provide a mold for a new plug having a smooth surface on the end having the larger cross-section.

DETAILED DESCRIPTION

The invention will now be illustrated in detail with reference to the accompanying drawings.

FIG. 1 is a perspective view of the mold having bituminous material poured into the mold cavities or cones, 11.

FIG. 2 is an enlarged exploded elevational side-view partly in section of the structure shown in FIG. 1.

FIG. 3 is a perspective view of two typical preferred conical shapes of the plugs of bituminous material 12 according to this invention after removal from the mold, 10.

Figure 4:
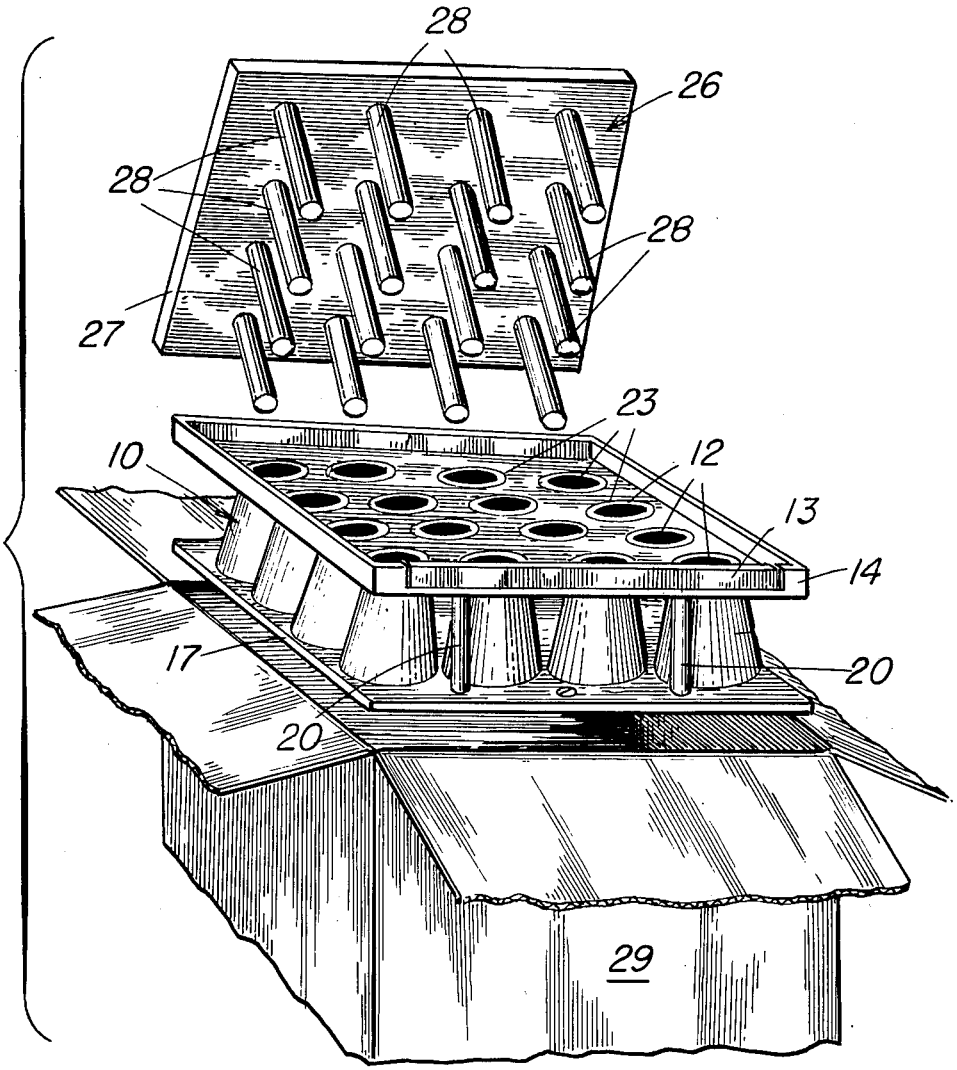

FIG. 4 is a perspective view of the mold 10 of this invention and a pegboard 26 illustrating the method by which plugs 12 are removed from the mold 10 for packaging in the container, 29.

Figure 5:
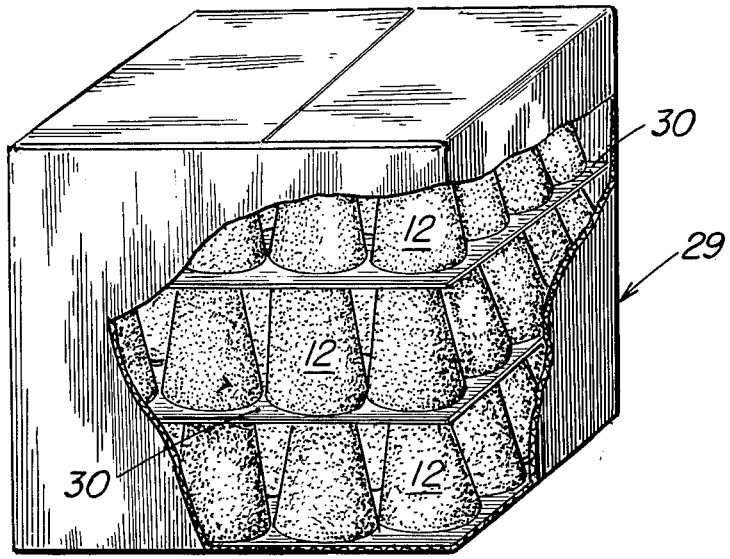

FIG. 5 is a perspective cut-away view of a typical container 29 used in the packaging of the improved plugs 12 of this invention.

FIG. 6 is a top view of a perforated plate 22 and FIG. 6*a* is a side view of the same plate 22.

FIG. 7 is a section taken along viewline 7—7 in FIG. 6 of the mold 10.

Referring again to the drawings, FIG. 1 illustrates a mold 10 with a plug of bituminous material 12 therein. The mold 10 comprises a plurality of truncated cones 11 connected to a bottom plate 17 and top plate 16. The cavities or cones 11 are open at both ends, but a base plate 18, which is locked by two bolts 19 to the bottom plate 17, provides a bottom closure for the conical cavities or cones 11. As seen in FIG. 2 the bottom plate 17 is secured to and spaced from the top plate 16 by the bolts 21 and three nuts each. The top plate 16 is provided with a lip 14 to trap overflowing molten bituminous material. Said lip 14 has a detachable gate bar 13 to facilitate removal of excess bituminous material. Said gate bar 13 is secured to the non-detachable portion of the lip 14 by locking means or bullet catches 15.

In the preferred embodiment described here, the mold is of aluminum metal, approximately 18 guage. Other materials including thin metals such as tin plate or plastics may be used. While preferred shape of the mold cavities is conical, the cavities need not be cones but must, in this invention, have the largest area opening adjacent to the base plate 18 so that on solidifying the smooth end of the plug will be at the end having the largest cross-section. Of course, the mold may contain one or more of the cones or cavities shown.

The metal or aluminum mold 10 is made from four metal or aluminum plates used to form bottom plate 17, top plate 16 and base plate 18. Holes or perforations for the cones in bottom plate 17 and top plate 16 perforated plate 22 to cover the swaged aluminum cones are formed, for example, by punching, starting with small pilot holes positioned at the centers of the desired larger holes. The top plate 16 has the lip 14 attached, for example, by bolting. Said lip 14 is provided with a removable side 13 that attaches to the remaining portion by latching means or bullet catches 15. The base plate 18 has two holes, for example, punched or drilled to accommodate bolts 19 for removably mounting or locking to bottom plate 17. Holes are also formed, for example, punched or drilled in bottom plate 17 for the bolts 19. Holes are also made or drilled in the top plate 16 and the bottom platw 17 for means to connect and space from each other the said top and bottom plate. In the preferred embodiment described here, these connecting and spacing means are flat head bolts 21 and three nuts. Cones 11 with a small lip around the circumference of their larger end are inserted in the bottom plate 17 holes and the top of these cones is mounted, for example, by swaging to the top plate 16 completing the mold unit 10. In addition, a smooth perforated plate 22 preferably of aluminum with identical holes conforming to the small diameter of the cones is bolted to top plate 16. This is done to provide easy removal of the hardened bituminous material or asphalt by a heated blade. The perforated plate 22 is seen in FIGS. 6, 6*a* and 7.

A pegboard 26 of wood or metal having pegs 28 attached to a pegboard base 27 is shown in FIG. 4. The positions of the pegs 28 are made to conform with the position of the conical mold cavities 11. The pegboard is used to remove the plugs 12 from the mold 10, for packaging in container 29.

One method of packaging a large quantity of plugs is shown in FIG. 5. Each layer of plugs results from a removal of plugs from a single mold unit 10. Successive layers in the container 29 are separated by planar spacers 30 of cardboard or stiff silicone paper.

The bituminous material of this invention contains an asphalt composition, for example, an asphalt which has been useful in the preparation of built up roof coverings, such as A.S.T.M. D-132 Asphalt, Types III and IV and combinations thereof. The Type IV composition is preferred for use on roads in temperate climates such as Great Britain or the United States excluding Alaska.

For colder climates, such as those of Canada and Alaska, Type III is preferred. The properties of these asphalt compositions are described in more detail in U.S. Pat. No. 3,699,854. Additionally, the bituminous material of this invention should contain other ingredients although at least 50 parts by weight are asphalt. These additional ingredients are mixed with the asphalt to form the plug's bituminous material in a heated kettle while the mixture is liquid and they include (a) rubber, in mesh size from No. 4 to No. 50 and preferably from No. 16 to No. 30 (American Standard screen sizes); (b) heavy industrial circulating oil of viscosity about 560 centistokes at 100° F; (c) wax having a melting point of about 300° F. The heavy oil, (for example, Regal Oil L of Texaco) is used to increase the ductility and resiliency of the final composition, while the wax, for example, Interstab G-8257, is used to restore the melting point lowered by the oil.

In preferred embodiments, a small quantity of rubber, from 6 to 12 parts by weight, from 3 to 6 parts by weight of heavy oil and from 1.5 to 2.5 parts by weight of wax are mixed with 80 to 89 parts by weight of molten asphalt in a heated kettle to form the desired bituminous material for the plugs. For use generally in the United States, it has been found that an optimum composition comprises (a) 84.8 parts by weight of asphalt, (b) 3.4 parts by weight of oil (Regal Oil L), (c) 10.1 parts by weight of rubber, and (d) 1.7 parts by weight of wax (Interstab G-8257).

The mold is initially flooded with a release agent (for example, No. 200 Dow Corning Silicone fluid in Isopropanol) and then allowed to drain. It is then suspended over water and molten bituminous material is poured in each cone 11 to overfill the cones or conical cavities 11. The mold is then immersed in water almost to the bottom of plate 16. Soon after pouring, the bar gate 13 is removed and the excess molten asphalt is allowed to flow off into the water.

The unit is then cooled in flowing cold water and the remaining asphalt is removed with a heated blade. The cooled mold 10 is inverted and the base plate 18 is removed exposing the smooth surface of the larger portion of the plugs 12 formed on said base plate 18. The mold 10 with the plugs 12 is then placed in the normal position over the box 29 in which the plugs 12 are to be packaged, as shown in FIG. 4. The pegboard 26 is positioned so that the pegs 28 contact the plugs 12. Downward pressure is applied to the pegboard 27 sliding the plugs 12 from the mold cavities 11 into the box 29 provided for packaging.

Each layer of plugs may be separated by partition pieces in the form of a plus sign (+) or crossed pieces of sheet material. Such pieces may be of corrugated paper board. Layers of plugs also may be separated within the container 29 or box by sheets of paper or by cardboard 30. Two typical similar or identical shapes of the plug 12 are shown in FIG. 3. The packaged plugs 12 are shown in FIG. 5 in one configuration.

FIGS. 6 and **6*a* illustrate the perforated cover plate 22 which is used to cover the top plate 16 to provide a smooth surface for scraping off excess bituminous material. FIG. 7 shows in elevation a section of the mold assembly in which the swaging 23 on the top of the cones and the rim 24 on the bottom plate 17 is seen. The cover plate 22 fits over the top plate 16 and covers the swaging 23 The cover plate 22 is provided with openings 22*a* which correspond with the openings of the trunicated cones or mold cavities 10. The cover plate 22 is also provided with pins or rivets 25 which are used to secure the cover plate to plate 16**.

The invention will be better understood by the following illustrative examples where the parts are by weight and the relationship between parts by weight and parts by volume is as that between grams and cubic centimeters

EXAMPLE 1

Ninety-seven parts of A.S.T.M. D-312 Asphalt, Type IV are melted in a heated kettle fitted with dispensing tap and three parts of finely divided rubber from automobile tires having American Standard screen size of 16 mesh. The rubber is blended with a paddle mixer and when the mixture is uniformly dispersed and molten, it is poured into an aluminum gang-type mold to yield the desired plug sizes as follows in Table I.

Table I

Size of Asphalt Composition Plug Repair Materials

| Size of Repair Plug | Hole to be Repaired (Inches) | Bottom Diameter of Repair Plug (Inches) | Top Diameter of Repair Plug (Inches) | Length of Repair Plug (Inches) |
|---|---|---|---|---|
| A | ¾ | ¾ | 1 | 1½ |
| B | 1 | ⅞ | 1¼ | 2⅜ |
| C | 1¼ | 1⅛ | 1½ | 2⅜ |
| D | 1½ | 1¼ | 1¾ | 3 |
| E | 1¾ | 1½ | 2 | 3 |
| F | 2 | 1¾ | 2¼ | 3 |
| G | 2¼ | 2 | 2½ | 3 |

Before filling, the gang-type mold having inverted cones of aproximately 18 gauge aluminum is flooded with a release compound, Dow Corning 200 Silicone Fluid (viscosity 350 centistokes) in Isopropanol and allowed to drain. The gang-type mold is suspended over water and the asphalt composition is poured into every cone to overfilling. The mold unit is then immersed into the water ⅜ of the way (2 inches in the water, 1 inch out). Soon after pouring, the lip gate is removed and the excess molten asphalt is allowed to flow off into the water. The entire unit is then cooled by water flow. When cool, the bottom plate is removed and the unit is suspended over the box or container in which the plugs are to be packaged. The excess asphalt is sheared off with a heated blade. Many of the plugs will release and fall into the box, for those remaining — a pegboard having pegs conforming to the positions of the cones is used to remove the plugs from the mold to the container by applying downward pressure to the pegs as they contact the plugs.

EXAMPLE II

A composition is prepared as in Example I, as follows:

79.5 parts asphalt
12 parts rubber
6 parts of a heavy industrial circulating oil having viscosity of about 560 centistokes at 100° F, identified as Regal Oil L of Texaco, Inc., New York, N.Y.
2.5 parts wax having a melting point approximately 300° F, identified as Interstab G-8257.

EXAMPLE III

A composition is prepared as in Example I, as follows:

89.5 parts asphalt
6 parts rubber 3 parts oil (same as described in Example II)
1.5 parts wax (same as described in Example II)

EXAMPLE IV

A preferred composition is prepared as in Example I, as follows:

84.8 parts asphalt
10.1 parts rubber
3.4 parts oil (same as described in Example II)
1.7 parts wax (same as described in Example II)

EXAMPLE V

A preferred composition is prepared as in Example I, as follows:

84 parts asphalt
6 parts rubber
8 parts oil (same as described in Example II)
2 parts wax (same as described in Example II)

If in the foregoing examples, asphalt A.S.T.M. D-312 Type III is used in place of Type IV, useful repair plugs for cold weather and cold climates are obtained. In each of the foregoing Examples II–V, the same procedure as described in Example I is used to obtain the desired plugs.

What is claimed is:

1. In a mold having at least one hollow truncated conical member having an upper open end with an outer rim and a bottom closed end adapted to be used to manufacture at least one plug of bituminous material for road repair, the improvement which comprises an upper, open end of each conical member, said upper end having a smaller cross-sectional area than the bottom end, said bottom end being closed with a smooth, readily detachable base plate and which is adapted to form a plug having a smooth upper end of larger cross-sectional area than the bottom end of said plug, said mold having a top plate with at least one opening of the same shape and area as the outer rim of the upper end of the truncated conical member, the said upper end of said conical member being secured to the said top plate adjacent the said rim so that the area of the upper open end of said truncated conical member is not diminished by said top plate, and the top plate is provided with a lip on the periphery of its upper surface so that when the hollow truncated conical member is slightly overfilled with molten bituminous material, said material will be contained on said top plate's upper surface, and said lip has a portion detachable therefrom to facilitate removal of excess bituminous material from the top plate by mechanical means, said mold being provided with a bottom plate spaced from, and connected to, said top plate by spacing and connecting means, having at least one openings conforming in position, area and shape with the bottom larger end of the hollow truncated conical member, said bottom plate being detachably secured to the smooth base plate.

2. The improvement according to claim 1 wherein said mold is provided with a perforated cover plate having openings of the same shape and size as those of the top plate of the mold and said cover plate is attached to said top plate by fastening means to form a rigid assembly.

* * * * *